United States Patent [19]

Kawamura

[11] Patent Number: 4,947,808

[45] Date of Patent: Aug. 14, 1990

[54] IGNITING DEVICE FOR ENGINE

[75] Inventor: Hideo Kawamura, Samukawa, Japan

[73] Assignee: Isuzu Motors Limited, Tokyo, Japan

[21] Appl. No.: 290,587

[22] Filed: Dec. 27, 1988

[30] Foreign Application Priority Data

Dec. 26, 1987 [JP] Japan ..... 62-330902

[51] Int. Cl.[5] ..... F02P 3/10

[52] U.S. Cl. ..... 123/145 A; 123/179 BG; 123/668

[58] Field of Search ..... 123/143 B, 145 A, 179 BG, 123/179 H, 668

[56] References Cited

U.S. PATENT DOCUMENTS 3,082,752 3/1963 Thomas ..... 123/668
4,162,669 7/1979 Igashira et al. ..... 123/145 A X
4,658,772 4/1987 Auth et al. ..... 123/145 A
4,748,947 6/1988 LoRusso et al. ..... 123/145 A

FOREIGN PATENT DOCUMENTS 1545865 5/1979 United Kingdom ..... 123/145 A

*Primary Examiner*—Argenbright, Tony M.
*Attorney, Agent, or Firm*—Staas & Halsey

[57] ABSTRACT

An igniting device for an engine has a glow plug disposed in a combustion chamber which is constructed of a thermally insulating material. When a temperature of the combustion chamber wall is lower than a predetermined temperature, the glow plug is supplied with electric power at a timing which is determined dependent upon the rotational speed of the engine and the top dead center position of a piston.

10 Claims, 2 Drawing Sheets

IGNITING DEVICE FOR ENGINE

BACKGROUND OF THE INVENTION

1. Field of the Invention

The present invention relates to an igniting device for a diesel engine having a thermal insulation structure made of a thermally insulating material such as ceramic or the like.

2. Description of the Related Art

There have been developed in recent years thermally insulated engines including various parts exposed to combustion gases. Elements such as a wall surface of a cylinder head which defines a combustion chamber, a piston head, intake, exhaust valves and exhaust ports are made of a thermally insulating material such as ceramic for higher thermal efficiency. A typical ceramic material used in such a thermally insulated engine is silicon nitride or the like, and which can withstand a high temperature of over one thousand degrees Celsius. The thermally insulated engine can operate even when the temperature of the wall of the combustion chamber reaches about 800° C.

It is important that fuel to be used in diesel engines be well ignitable, and the ignitability of diesel fuel is indicated by a cetane number. A cetane number is represented by a ratio by volume of more ignitable cetane ($C_{16}H_{34}$) to less ignitable $\alpha$-methylnaphthalene ($C_{11}H_{10}$). In Japan, the cetane number of light oil is about 55, and light oil having a cetane number of about 55 is used as fuel for ordinary diesel engines.

In a thermally insulated engine, the temperature of the wall of a combustion chamber is high. Since intake air introduced into the combustion chamber takes the heat of the combustion chamber wall, the temperature of the intake air as it is compressed in the combustion chamber is increased. If fuel having a cetane number of about 55, used for normal diesel engines, is used in such a thermally insulated engine, the fuel may be self-ignited resulting in so-called diesel knocking.

FIG. 3 is a graph showing the relationship between the crank angle and the temperature of a cylinder wall while a diesel engine is in operation. The graph has a horizontal axis representing the crank angle and a vertical axis indicating the cylinder wall temperature.

A solid-line curve in FIG. 3 shows the relationship between the crank angle and the cylinder wall temperature when fuel having a low cetane number is used in an ordinary diesel engine. The fuel is not combusted well because the ignitability of the fuel is poor.

In a thermally insulated engine, as indicated by the dotted-line curve in FIG. 3, air introduced into the cylinder takes heat from the high-temperature wall of the combustion chamber, and hence the temperature of the air as it starts to be compressed is high, so that the temperature of the air at the end of the compression stroke (0° top dead center) is higher than that in the ordinary diesel engine. Consequently as seen in FIG. 3, the cylinder wall temperature of the thermally insulated engine is correspondingly lower at 0° top dead center than the ordinary diesel engine. Therefore, the thermally insulated engine allows fuel, even if it is of a low cetane number, to be ignited.

When the thermally insulated engine is under a high load with the temperature of the combustion chamber wall reaching 600° C., intake air is heated to such a temperature that fuel having a low cetane number can ignite. However, when the temperature of the combustion chamber wall is low at the time of starting the thermally insulated engine or operating the engine under a low load, the temperature of intake air cannot be increased to a point capable of igniting fuel. Thus, fuel of a low cetane number cannot be ignited.

In order to ignite fuel of a low cetane number under a low engine load, a glow plug used as a device for assisting in starting a diesel engine may be energized even in a low engine load condition for assisting in igniting the fuel. However, unless energization timing and an energizing current were controlled, supplied electric power would be wasted and the durability of the glow plug would be lowered resulting in early glow plug breakage.

SUMMARY OF THE INVENTION

It is an object of the present invention to provide an igniting device for an engine, which can ignite fuel of a low cetane number efficiently even when the engine is under a low load.

Another object of the present invention is to provide an igniting device for an engine, which prevents wasteful consumption of electric power supplied to a glow plug which is disposed as a heating means in a combustion chamber of the engine, and which also prevents the glow plug from degrading in durability.

According to the present invention, there is provided an igniting device for an engine having a combustion chamber constructed of a thermally insulating material, comprising: a glow plug disposed in the combustion chamber and heatable by electric power supplied thereto; an engine speed sensor for detecting the rotational speed of the engine; a top dead center sensor for detecting the top dead center position of a piston of the engine; a combustion chamber wall temperature sensor for detecting the temperature of a wall of the combustion chamber; means for setting a timing for energizing said glow plug based on signals from said engine speed sensor and said top dead center sensor; and means for energizing said glow plug at the timing set by said timing setting means when the temperature of the wall of said combustion chamber based on a signal from said combustion chamber wall temperature sensor is lower than a preset temperature.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
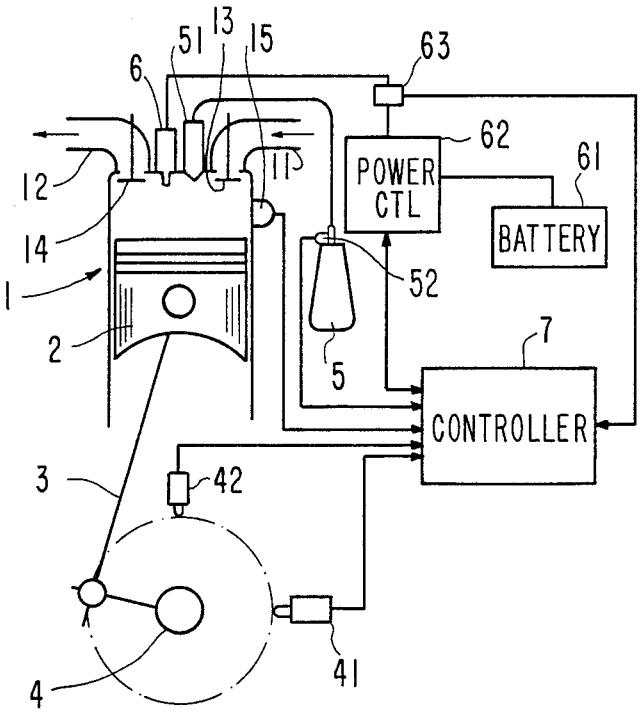
FIG. 1 is a block diagram of an igniting device for an engine according to an embodiment of the present invention.

As shown in FIG. 1, a diesel engine has a cylinder 1 in which a linearly movable piston 2 is disposed. Linear movement of the piston 2 is converted into rotary movement of a crankshaft 4 by means of a connecting rod 3. The speed of rotation of the crankshaft 4, i.e., the engine rotational speed, is detected by an engine speed sensor 41. The top dead center position of the piston 2 is detected by a top dead center sensor 42.

An intake pipe 11 and an exhaust pipe 12 are connected to the cylinder 1 at junction regions where an intake valve 13 and an exhaust valve 14 are disposed for opening and closing intake and exhaust passages joined to the cylinder 1. A combustion chamber wall temperature sensor 15 is mounted on the cylinder 1 for producing a temperature signal representing the temperature of the inner wall surface of the cylinder 1. A fuel injection pump 5 supplies fuel from a fuel tank into the cylinder 1 through an injection nozzle 51. An engine load sensor 52 serves to detect the amount of fuel supplied to the cylinder 1, which corresponds to an engine load, and sends a detected signal to a controller 7 (described later on). A glow plug 6 projects into the combustion chamber for assisting in igniting fuel supplied into the cylinder 1. The glow plug 6 is supplied with electric power from a battery 61 through a power control unit 62. The glow plug 6 has therein a resistance wire with a positive temperature coefficient, and is heated by energizing the resistance wire. The temperature of the glow plug 6 is detected by a glow plug temperature sensor 63 which detects the value of electric resistance of the resistance wire of the glow plug 6.

The various portions of the engine, such as the cylinder, the piston, the intake and exhaust valves which jointly constitute the combustion chamber and are heated to a high temperature, are made of ceramic so as to be thermally insulated.

A controller 7 comprises a microcomputer and has a processor, a memory, an I/O circuit, etc. The controller 7 is supplied with signals from the engine speed sensor 41, the top dead center sensor 42, the engine load sensor 52, the combustion chamber wall temperature sensor 15, and the glow plug temperature sensor 63. Dependent upon these signals, the controller 7 issues a command signal to the power control unit 62 according to a control program stored in the memory for controlling the electric power supplied to the glow plug 6.

Figure 2:
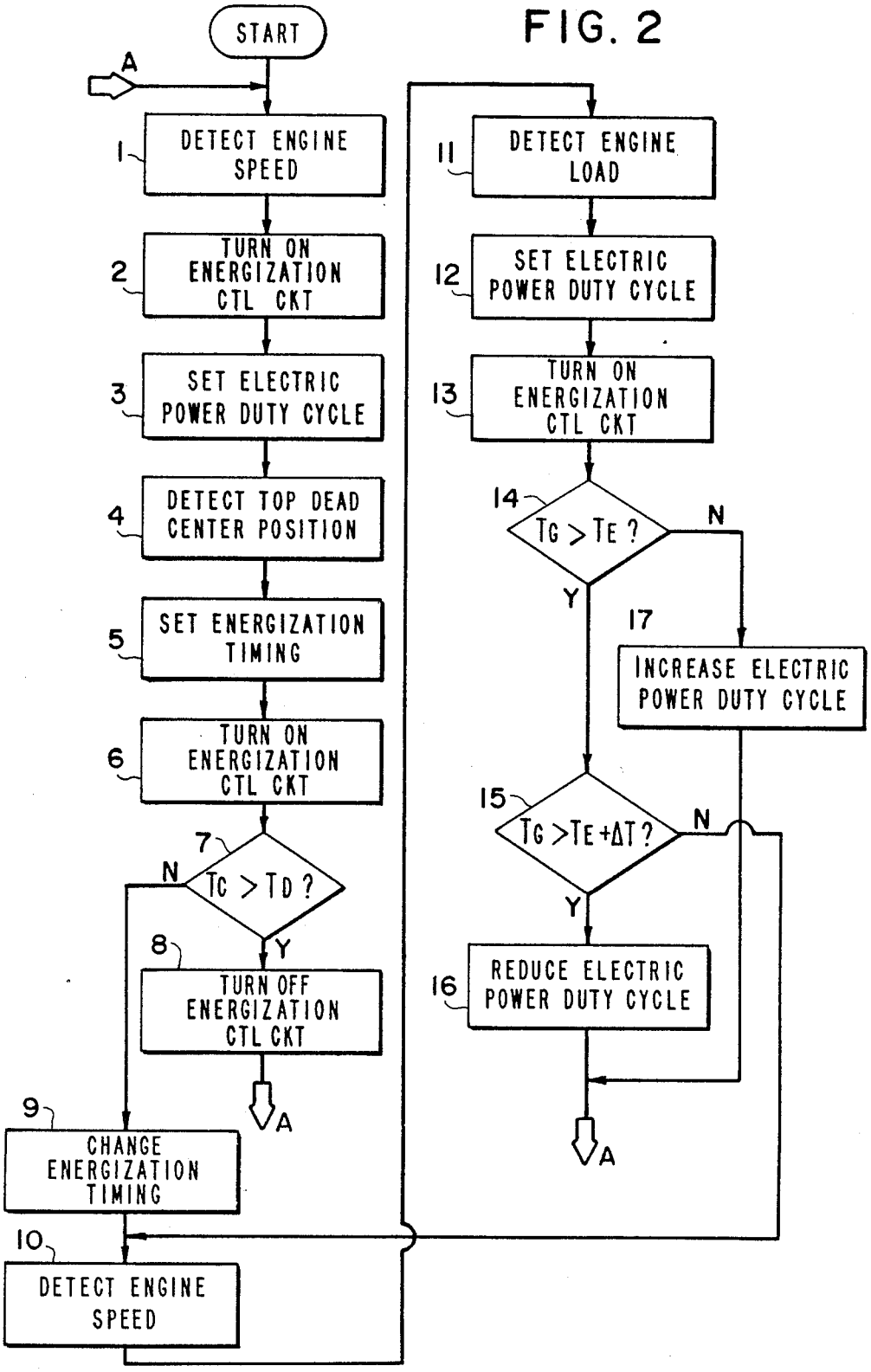
FIG. 2 is a flowchart of an operation sequence of the igniting device.

An operation sequence of the igniting device will be described below with reference to FIG. 2.

Figure 3:
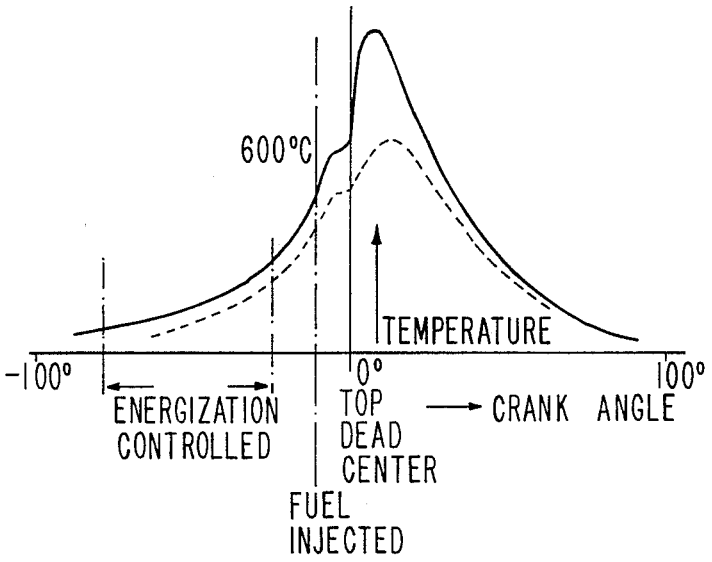
FIG. 3 is a graph showing the relationship between the crank angle and the temperature of the wall of a combustion chamber while the engine is in operation.

In a step 1, the engine rotational speed is detected according to a signal from the engine speed sensor 41, and an energization control circuit in the power control unit 62 is turned on in a step 2. In a step 3, the duty cycle of electric power to be supplied to the glow plug 6 is set, dependent on the detected engine rotational speed, according to the control program stored in the memory. A step 4 detects the top dead center position of the piston 2 based on a signal from the top dead center sensor 42, and checks whether the stroke of the piston 2 is a compression stroke, a power stroke, or an exhaust stroke. The timing for energizing the glow plug 6 is set in a step 5, and then the energization control circuit is turned on within the range shown in FIG. 3 in a step 6.

A step 7 then checks the temperature $T_C$ of the combustion chamber wall based on a signal from the combustion chamber wall temperature sensor 15. If the combustion chamber wall temperature $T_C$ is higher than a preset temperature $T_D$, i.e., if the combustion chamber wall temperature is sufficiently high, then the glow plug 6 is deenergized in a step 8. If the combustion chamber wall temperature $T_C$ is lower than the preset temperature $T_D$ in the step 7, then control goes to a step 9 in which the energization timing of the glow plug 6 is changed, and then goes to a step 10.

The step 10 detects the engine rotational speed based on the signal from the engine speed sensor 41. A step 11 then detects the engine load based on a signal from the engine load sensor 52. The duty cycle of electric power to be supplied to the glow plug 6 through the power control unit 62 is set in a step 12. In a step 13, the glow plug 6 is energized.

A step 14 then checks the temperature $T_G$ of the glow plug 6 based on a signal from the glow plug temperature sensor 63. If the temperature $T_G$ of the glow plug 6 is higher than a preset temperature $T_E$ ($T_G > T_E$), then a step 15 determines whether the glow plug temperature $T_G$ has reached a higher temperature $T_E + \Delta T$ which is the sum of the preset temperature change $T_E$ and a small temperature $\Delta T$. If the glow plug temperature $T_G$ has reached the temperature $T_E + \Delta T$ ($T_G > T_E + \Delta T$), then the duty cycle of electric power to be supplied to the glow plug 6 is reduced in a step 16. If the glow plug temperature $T_G$ has not reached the temperature $T_E + \Delta T$, then control returns to the step 10, and those steps following the step 10 are repeated. If the glow plug temperature $T_G$ is lower than the preset temperature $T_E$, then the power control unit 62 is commanded to increase the duty cycle of electric power to be supplied to the glow plug 6.

With the present invention, as described above, the glow plug is disposed in the combustion chamber, and the electric current to be supplied to the glow plug and the timing for energizing the glow plug are controlled based on the engine rotational speed, the engine load, the temperature of the combustion chamber wall, and the temperature of the glow plug, for controlling the ignition of fuel supplied into the combustion chamber. Therefore, where less ignitable fuel having a cetane number of about 20 is used in a thermally insulated engine, the fuel can be efficiently ignited even if the engine is under a low load. Furthermore, consumption of electric power by the glow plug is minimized, with result that the durability of the glow plug is enhanced.

Although a certain preferred embodiment has been shown and described, it should be understood that many changes and modifications may be made therein without departing from the scope of the appended claims.

What is claimed is:

1. An igniting device for an engine having a combustion chamber and piston and including a thermally insulating material, comprising:

a glow plug disposed in the combustion chamber and heatable by electric power;

an engine speed sensor connected to the engine, detecting a rotational speed of the engine;

a top dead center sensor connected to the engine, detecting a top dead center position of the piston;

a combustion chamber wall temperature sensor connected to the combustion chamber, detecting a wall temperature of the combustion chamber;

timing means for setting a timing for energizing said glow plug based on signals from said engine speed sensor and said top dead center sensor; and energizing means for energizing said glow plug at the timing set by said timing means when the wall temperature detected by said combustion chamber wall temperature sensor is lower than a preset temperature.

2. An igniting device according to claim 1, further including a glow plug temperature sensor connected to said glow plug, detecting a temperature of said glow plug when said glow plug is energized, and power increasing means controlling said energizing means for increasing electric power to said glow plug when the temperature of said glow plug detected by said glow plug temperature sensor is lower than a first preset glow plug temperature value.

3. An igniting device according to claim 1, further including a glow plug temperature sensor connected to said glow plug and detecting a temperature of said glow plug when said glow plug is energized, and power reducing means, controlling said energizing means, for reducing electric power to said glow plug when the temperature of said glow plug detected by said glow plug temperature sensor is higher than a second preset glow plug temperature value.

4. An igniting device for an engine having a combustion chamber and piston and including a thermally insulating material, comprising:

a glow plug disposed in the combustion chamber and heatable by electric power;

an engine speed sensor connected to the engine detecting a rotational speed of the engine;

a top dead center sensor connected to the engine detecting a top dead center position of the piston;

a combustion chamber wall temperature sensor connected to the combustion chamber detecting a wall temperature of the combustion chamber;

an engine load sensor connected to the engine detecting a load on the engine;

timing means for setting a timing for energizing said glow plug based on signals from said engine speed sensor and said top dead center sensor;

electric power setting means for setting an amount of electric power to be supplied to said glow plug based on signals from said engine speed sensor and said engine load sensor; and power supply means for supplying said glow plug with electric power set by said electric power setting means at the timing set by said timing setting means when the wall temperature detected by said combustion chamber wall temperature sensor is lower than a preset temperature.

5. An igniting device according to claim 4, further including a glow plug temperature sensor connected to said glow plug detecting a temperature of said glow plug when said glow plug is energized, and power increasing means for increasing electric power to said glow plug when the temperature detected by said glow plug temperature sensor is lower than a first preset glow plug temperature value.

6. An igniting device according to claim 4, further including a glow plug temperature sensor connected to said glow plug detecting a temperature of said glow plug when said glow plug is energized, and power reducing means for reducing electric power to said glow plug when the temperature of said glow plug detected by said glow plug temperature sensor is higher than a second preset glow plug temperature value.

7. A method of controlling ignition in a combustion chamber having a glow plug, piston and thermally insulating material, said method comprising the steps of:

detecting engine speed, combustion chamber temperature and a top dead center position of the piston;

calculating a duty cycle and timing for energizing the glow plug dependent upon the detected engine speed and top dead center position; and energizing the glow plug in accordance with said calculated duty cycle and timing and changing the value of said calculated duty cycle when the detected combustion chamber temperature is less than a predetermined value.

8. The method according to claim 7, further including the step of de-energizing the glow plug when the detected combustion chamber temperature exceeds the predetermined value.

9. The method according to claim 7, wherein said detecting step includes detecting a temperature of the glow plug and said method further includes the step of:

increasing the value of said calculated duty cycle when the detected glow plug temperature is less than a first predetermined glow plug temperature.

10. The method according to claim 7, wherein said detecting step includes detecting a temperature of the glow plug and said method further includes the step of:

decreasing the value of said calculated duty cycle when the detected glow plug temperature is greater than a second predetermined glow plug temperature, the second predetermined glow plug temperature being greater than the first predetermined glow plug temperature.

* * * * *

UNITED STATES PATENT AND TRADEMARK OFFICE

CERTIFICATE OF CORRECTION

PATENT NO. : 4,947,808

DATED : August 14, 1990

INVENTOR(S) : Hideo Kawamura

It is certified that error appears in the above-identified patent and that said Letters Patent is hereby corrected as shown below:

FRONT PAGE, Col. 2, delete "FOREIGN PATENT DOCUMENTS" in its entirety and insert the following new sections which were inadvertently ommitted at the Patent Office:

--FOREIGN PATENT DOCUMENTS

| | | | |
|---|---|---|---|
| 0075872 | 4/1983 | Europe | ..... |
| 0183038 | 6/1986 | Europe | ..... |
| 1545865 | 5/1979 | United Kingdom | ....123/145A |
| 2159578 | 12/1985 | United Kingdom | .... |

OTHER PUBLICATIONS

Motohiro Nizawa, "Glow Plug Temperature Control Device for Cylinder Injection Type Internal-Combusion Engine", Publication Date: February 22, 1984, Publication No. 59-32676 (A), Japanese Abstract.

Isanori Akagi, "Diesel Engine", Publication Date: December 12, 1981, Publication No. 56-167857 (A), Japanese Abstract.

UNITED STATES PATENT AND TRADEMARK OFFICE

CERTIFICATE OF CORRECTION

PATENT NO. : 4,947,808

DATED : August 14, 1990

INVENTOR(S) : Hideo Kawamura

It is certified that error appears in the above-identified patent and that said Letters Patent is hereby corrected as shown below:

Sadao Arakawa, "Combustion Chamber Heating Device for Internal-Combustion Engine", Publication Date: November 1, 1983, Publication No. 58-187582 (A), Japanese Abstract.

Masaomi Nagase, "Control Method of Electric Current Conduction in Glow Plug of Diesel Engine, Publication Date: March 12, 1984, Publication No. 59-43983 (A), Japanese Abstract.--.

Col. 1, line 19, "and" should be deleted.

Col. 4, line 16, "change" should be deleted; and
line 17, "temperature ΔT." should be --temperature change ΔT.--;

Signed and Sealed this

Fourth Day of February, 1992

*Attest:*

HARRY F. MANBECK, JR.

*Attesting Officer*

*Commissioner of Patents and Trademarks*